United States Patent [19]

Dussourd et al.

[11] 4,295,788

[45] Oct. 20, 1981

[54] TURBINE WHEEL AND NOZZLE ARRANGEMENT

[75] Inventors: Jules L. Dussourd, Princeton; George W. Pfannebecker, Skillman, both of N.J.

[73] Assignee: Terry Corporation, Windsor, Conn.

[21] Appl. No.: 129,038

[22] Filed: Mar. 10, 1980

[51] Int. Cl.[3] ..... F01D 9/02

[52] U.S. Cl. ..... 415/202; 415/202 R

[58] Field of Search ..... 415/202

[56] References Cited

U.S. PATENT DOCUMENTS

| | | | |
|---|---|---|---|
| 812,795 | 2/1906 | Keller | 415/202 |
| 1,412,257 | 4/1922 | Petsche | 415/202 |
| 4,150,918 | 4/1979 | Theis | 415/202 |

OTHER PUBLICATIONS

*Steam and Gas Turbines,* Stodola, A, Peter Smith, New York, 1945, pp. 174–175.

*Principles of Turbomachinery,* Shepherd, D. G., MacMillian Co., 1956, pp. 83–87, 316–319, 350–355.

*Primary Examiner*—Leonard E. Smith

*Attorney, Agent, or Firm*—D. W. Tibbott; B. J. Murphy

[57] ABSTRACT

The arrangement comprises a turbine wheel having semicircular buckets milled into the periphery thereof and a steam or gas-discharging nozzle operatively associated therewith, according to prior art practices, in which an improved, efficiency-enhancing ratio of bucket radius to nozzle width is set forth, defined and depicted.

2 Claims, 3 Drawing Figures

TURBINE WHEEL AND NOZZLE ARRANGEMENT

Figure 1:
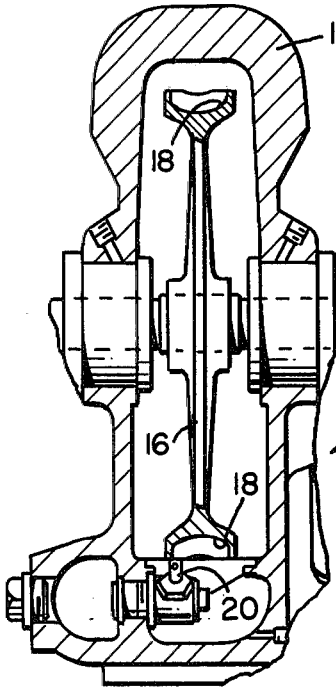

This invention pertains to turbines and the like, and in particular to steam or gas turbines having a solid wheel, in the periphery of which buckets have been milled, and a steam or gas-nozzle operatively associated therewith.

In the field of turbines, the solid, milled-bucket, turbine wheel and steam or gas nozzle arrangement has been standard equipment for many years, even back to the turn of the century, with some improvement and modification over the years. However, with ever increasing sensitivity toward energy savings, improvements in turbine efficiency are of interest, particularly at lower speeds than those in which maximum efficiency occurs. That is, due to the increase, for instance, in steam supply pressures and temperatures over the years most steam turbine applications now require operations at lower speed ratios. Therefore, it is an object of this invention to set forth an improved milled-bucket, turbine wheel and nozzle arrangement manifesting a general increased efficiency, and particularly an increased efficiency at the lower speed ratios.

Specifically, it is an object of this invention to disclose an improved milled-bucket, turbine wheel and nozzle arrangement, for a machine comprising a milled-bucket, turbine wheel mounted for rotation; and an energized-fluid-discharging nozzle mounted in adjacency to the periphery of said wheel, for discharging energized fluid onto said periphery; wherein said wheel has a plurality of substantially parallel, arcuate buckets formed in, and in traverse of, the periphery thereof; and said nozzle has a fluid-exit orifice opening onto, and in aligned registry with a given side portion or area of said periphery whereat there subsist lateral terminations of said buckets; wherein the improvement comprises: said buckets are substantially semicircular in cross-section, having a given radius; and said orifice has a width, measured along a plane traversing said wheel periphery which is not less than approximately fifteen and one third percent, nor more than approximately eighteen and one fifth percent of twice said given radius.

It is also an object of this invention to set forth an improved milled-bucket turbine wheel and nozzle arrangement, for a machine, comprising a milled-bucket turbine wheel mounted for rotation; and an energized-fluid-discharging nozzle mounted in adjacency to the periphery of said wheel, for discharging energized fluid onto said periphery; wherein said wheel has a plurality of substantially parallel, arcuate buckets formed in, and in traverse of, the periphery thereof; and said nozzle has a fluid-exit orifice opening onto, and in aligned registry with a given side portion or area of said periphery whereat there subsist lateral terminations of said buckets; wherein the improvement comprises: said buckets are substantially semicircular in cross-section, having a given radius R; said orifice has a width h, measured along a plane traversing said wheel periphery; and the ratio 2R/h is greater than 5.5 and smaller than 6.5.

Figure 3:
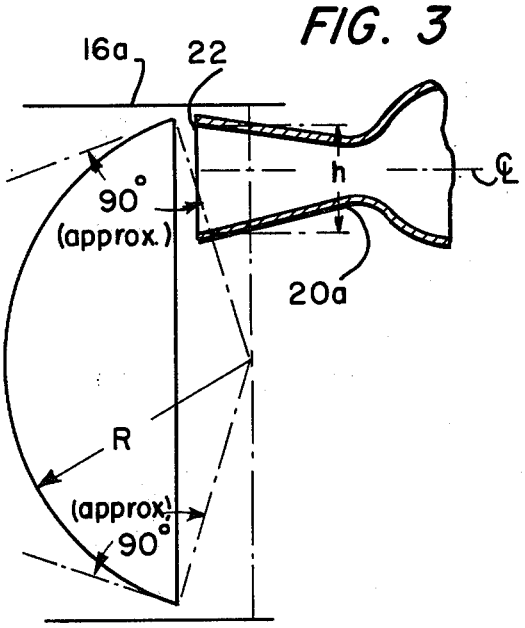
Figure 2:
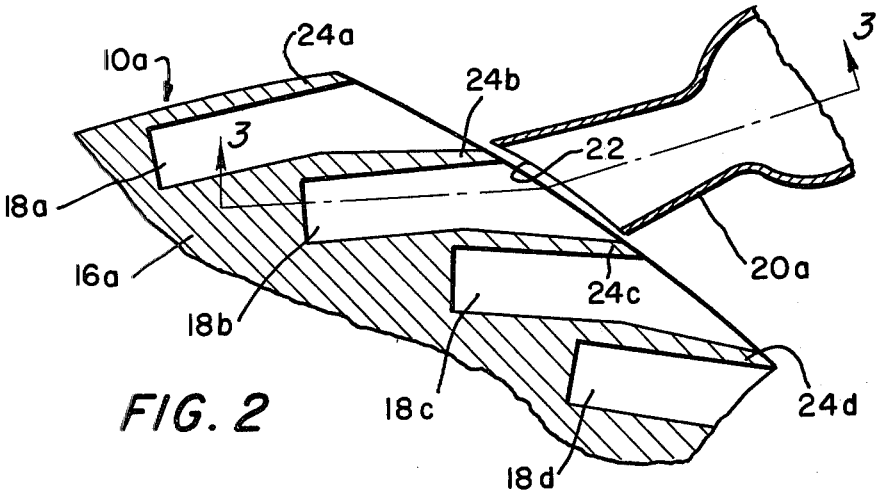

Further objects of this invention, as well as the novel features thereof, will become more apparent by reference to the following description taken in conjunction with the accompanying figures, in which:

FIG. 1 is a cross-sectional view of a portion of a steam turbine, showing the milled-bucket turbine wheel and a nozzle, according to prior art practices; and FIGS. 2 and 3 are cross-sectional views of a milled-bucket turbine wheel and nozzle arrangement according to an embodiment of the invention. FIG. 2 is a fragmentary, cross-sectional view taken vertically through the wheel on a plane normal to the axis of wheel rotation. FIG. 3 is a cross-sectional view taken along 3—3 of FIG. 2.

As shown in FIG. 1, a turbine 10 comprises a housing 12 in which, on a shaft 14, a milled-bucket turbine wheel 16 is rotatably mounted. A plurality of relatively shallow, arcuate buckets 18 (two being shown) are formed in the periphery of the wheel 16. A steam-discharging nozzle 20 (one, of others not shown) is mounted to the housing 12 to cause steam to issue therefrom into the buckets 18 (to drive the wheel in rotation).

The aforesaid is rather conventional in the prior art; it is typical of present-day milled-bucket turbine wheel and nozzle arrangements.

Now, firstly, it was our determination that the contour as well as the depth of the buckets 18 (FIG. 1) were not conducive to maximum efficiency. Through analysis, calculation and testing, we determined that the buckets should define a full one hundred and eighty-degree turn, or substantially so—as cutting techniques and tools will allow. There is some teaching of full, semicircular buckets, and methods of forming them, in prior art. U.S. Pat. No. 930,383, issued Aug. 10, 1909, to Huldreich Keller, for a Method of Forming U-Shaped Turbine-Buckets, and U.S. Pat. No. 1,081,242, issued Dec. 9, 1913, to John F. Lyons, for a Machine for Milling Turbine Buckets, are deemed to be exemplary. However, we further determined that full turn (i.e., 180°) buckets are not necessarily, per se, significantly more efficient, without more.

A smoothly formed, full turn bucket will mor effectively and smoothly guide the flow of energized fluid (viz: steam), but to derive a maximum transfer of energy, we discovered that another critical parameter needed optimizing.

If an exceedingly narrow stream of energized fluid is addressed to an entry side of a bucket, a marked percentage thereof becomes frictionally involved with the arcuate wall of the bucket, and its energy component is quickly attenuated. On the other hand, if an inordinately wide stream of energized fluid is addressed to the bucket, the percentage thereof which suffers from frictionally-induced attrition is less. However, an inordinate percentage of the wider flow, i.e. the innermost portion of the energized fluid, which is most removed from the bucket wall, breaks down into counter-productive eddies and turbulences. For being relatively remote from the bucket wall, this fluid portion lacks a confined or guided direction. Also, it is constrained into a short turning radius which it cannot accommodate while exhibiting smooth flow. Hence, the turbulence results.

We have discovered that there is a critical range of ratios, between the width of the nozzle discharge orifice, and the radius of the bucket, which needs to be observed. FIGS. 2 and 3 depict an embodiment of the improved milled-bucket turbine wheel and nozzle arrangement incorporating the critical ratio range.

As shown in FIGS. 2 and 3, a turbine **10*a* comprises a milled-bucket turbine wheel 16*a* (rotatably supported in a housing, not shown) having a plurality of substantially semicircular buckets 18*a*–18*d*. The aforesaid buckets have a nominal radius R, and the nozzle 20*a* has an orifice 22 the width of which is h. What we have determined is that, for optimum efficiency, with any given energized fluid flow rate, the ratio 2R/h must be greater than 5.5 and smaller that 6.5. When this range of ratios is observed, the largest possible force is impressed upon the wheel 16***a* for the given rate of flow of fluid (viz: steam).

Between the buckets 18*a*–18*d* there obtains residual metal which comprises blades 24*a*–24*d*. Now, in the course of our investigation, we uncovered a milled-bucket turbine wheel and nozzles correlation/calculation chart in use in the prior art by a world-renowned manufacture of steam/milled-bucket turbines. The chart defines optimum quantities of nozzles and nozzle diameters, vis-a-vis areas of the "mouths" defined by the buckets, and the like. Further the chart carries a notation that "max. nozzle size is 20% of width of blade". Patently, this does not prefigure our invention, as blade width is not the proper parameter for the aforesaid ratio. Further, nozzle size, per se, is not critical; rather, it is the size of the nozzle orifice transverse to the periphery of the wheel, i.e., orifice width, which is material. More, the width of the nozzle orifice 22 is not to be as great as twenty percent; this would move the arrangement into the area of inefficiency. The width of the nozzle orifice 22, according to our teaching, must not be less than approximately fifteen and a third percent of the bucket "diameter" (i.e., 2R), nor more than approximately eighteen and fifth percent (of 2R).

While we have described our invention in connection with a specific embodiment thereof, it is to be clearly understood that this is done only by way of example, and not as a limitation to the scope of our invention as set forth in the objects thereof and in the appended claims.

We claim:

1. An improved milled-bucket turbine wheel and nozzle arrangement, for a machine comprising:

a milled-bucket turbine wheel mounted for rotation; and an energized-fluid-discharging nozzle mounted in adjacency to the periphery of said wheel, for discharging energized fluid onto said periphery; wherein said wheel has a plurality of substantially parallel, arcuate buckets formed in, and in traverse of, the periphery thereof; and said nozzle has a fluid-exit orifice opening onto, and in aligned registry with a given side portion or area of said periphery whereat there subsist lateral terminations of said buckets; wherein the improvement comprises:

said buckets are substantially semicircular in cross-section, having a given radius; and said orifice has a width, measured along a plane traversin said wheel periphery, which is not less than approximately fifteen and one third percent, nor more than approximately eighteen and one fifth percent of twice said given radius.

2. An improved milled-bucket turbine wheel and nozzle arrangement, for a machine, comprising:

a milled-bucket turbine wheel mounted for rotation; and an energized-fluid-discharging nozzle mounted in adjacency to the periphery of said wheel, for discharging energized fluid onto said periphery; wherein said wheel has a plurality of substantially parallel, arcuate buckets formed in, and in traverse of, the periphery, thereof; and said nozzle has a fluid-exit orifice opening onto, and in aligned registry with a given side portion or area of said periphery whereat there subsist lateral terminations of said buckets; wherein the improvement comprises:

said buckets are substantially semicircular in cross-section; having a given radius R;

said orifice has a width h, measured along a plane traversing said wheel periphery; and the ratio 2R/h is greater than 5.5 and smaller than 6.5.

* * * * *